United States Patent [19]

Bailey

[11] 4,008,745

[45] Feb. 22, 1977

[54] PANELED DOOR CONSTRUCTION

[75] Inventor: Morris W. Bailey, Fort Worth, Tex.

[73] Assignee: Overhead Door Corporation, Dallas, Tex.

[22] Filed: Feb. 21, 1975

[21] Appl. No.: 551,894

[52] U.S. Cl. ..... 160/229 R; 160/201; 160/236

[51] Int. Cl.[2] ..... E06B 3/12

[58] Field of Search ..... 160/229 R, 232, 235, 160/236, 201

[56] References Cited

UNITED STATES PATENTS

| | | | |
|---|---|---|---|
| 2,959,221 | 11/1960 | Clapsaddle, Jr. | 160/201 |
| 2,993,572 | 7/1961 | Rich | 160/229 R X |
| 3,648,755 | 3/1972 | Thiele | 160/201 |
| 3,891,021 | 6/1975 | Geoffrey | 160/201 X |

*Primary Examiner*—Philip C. Kannan
*Attorney, Agent, or Firm*—Woodhams, Blanchard and Flynn

[57] ABSTRACT

A sectional door having a plurality of horizontally elongated and substantially rectangular panels having their adjacent horizontally extending edges hingedly connected to permit movement of the door between a closed substantially vertical position and an open substantially horizontal position. Each panel includes an elongated section member formed from a thin sheetlike material and having a generally channel-shaped cross-section. The section member has opposed leg portions of short length interconnected by a web portion which has a width several times greater than the length of the leg portions. The web portion includes a stiffening portion formed centrally thereof and extending longitudinally throughout the length of the section member. The stiffening portion is of a channel-shaped cross section which opens outwardly in a direction opposite to the channel-shaped section member. The channel-shaped stiffening portion has a depth which is at least approximately 70% of the depth of the panel.

4 Claims, 9 Drawing Figures

PANELED DOOR CONSTRUCTION

FIELD OF THE INVENTION

This invention relates to a door structure and, in particular, to an improved door panel associated with a door formed from a plurality of hingedly connected panels which provide the flexibility to permit movement of the door between open and closed positions.

BACKGROUND OF THE INVENTION

Doors of the type used for closing a large opening in a building, such as a garage door, have long been manufactured utilizing a plurality of substantially identical panels which are hingedly connected together to permit relative hinging movement between the adjacent panels when the door is being moved between a closed vertical position and an open horizontal position. Such multipanel doors, commonly referred to as sectional doors, often employ individual wooden panels which are appropriately hingedly connected at the adjacent horizontal eddges thereof. However, wooden panels are costly to manufacture and result in the door being extremely heavy, particularly when the door is of large size. The weight of such doors thus makes opening and closing of the door extremely difficult, even when an automatic operator is utilized.

In an effort to improve upon sectional doors, panels which are rolled or formed from a thin sheet material, such as metal, fiberglass or plastic, have been utilized. These rolled or formed panels are necessarily provided with some form of irregular cross-section, such as a channel shape, so as to provide the panels with increased strength and rigidity. However, such panels have still required the use of additional strengthening members in the form of end stiles which are normally secured to each panel along the vertically extending edges thereof. These panels are also normally provided with a rigid reinforcing member in the form of a center stile which is rigidly attached to the panel to improve the strength thereof. These end and center stiles, which all extend in the direction of the door height, have provided the door with substantial strength in the direction of height, while still resulting in a rather light weight yet strong door.

While doors using formed or rolled panels as described above have proven acceptable, and in fact desirable, in some use situations, nevertheless many doors constructed from such panels have proven undesirable in other use situations. Specifically, in situations where the door is of substantial width, it has been discovered that the door does not possess the necessary strength and rigidity along the width direction thereof so as to be capable of withstanding transverse loads of rather large magnitude, such as wind loads.

Particularly, the panels of these known sectional doors are commonly formed with a channel-like cross section which is necessarily of rather limited depth in relationship to the overall door thickness, such as a maximum of approximately 50% of the overall door thickness. Thus, even though such channel-shaped panels are provided for the purpose of increasing the strength of the door along the width direction thereof, nevertheless these channel-shaped panels have not imparted the required strength and rigidity in all use situations. Thus, where the door is extremely wide and a rather large wind load is imposed on the door, the wind load causes the center portion of the door to deflect inwardly, which in turn causes the edge portions of the door and the rollers mounted thereon to be withdrawn from the supporting tracks. Needless to say, this weakness in the door as viewed in the width direction thereof, which weakness permits sufficient deflection or bowing of the door to cause disengagement of the door rollers from the supporting tracks, is highly undesirable since it disrupts proper door operation and in some instances results in damage to the door and its related support structure.

Accordingly, the present invention relates to an improved sectional door which overcomes the abovementioned disadvantages. Specifically, it is an object of the present invention to provide:

1. A sectional or multipanel door wherein the individual panels have a cross section of increased depth to provide the panels with increased strength, particularly in the longitudinal direction thereof, so that the door has substantially increased strength in the width direction thereof.

2. A door, as aforesaid, which utilizes panels having a channel-like center portion for strengthening the panels in the lengthwise direction thereof, which center portion has a depth which is at least approximately 75% and preferably approximately 80% of the door thickness to provide the panel with substantially increased strength and rigidity.

3. A door, as aforesaid, wherein the improved panel strength permits the assembled door to utilize end and center stiles of substantially reduced size and cross section.

4. A door, as aforesaid, which is capable of withstanding relatively large transverse loads, such as wind loads, even when the door is of substantial width.

5. A door, as aforesaid, which can be of lighter weight without sacrificing strength by providing increased strength due to the improved cross-sectional configuration of the individual panels.

6. A door, as aforesaid, which simplifies the production of the individual panels and permits a more efficient production of the assembled door.

Other objects and purposes of the invention will be apparent to persons acquainted with structures of this type upon reading the following specification and inspecting the accompanying drawings.

Figure 1:
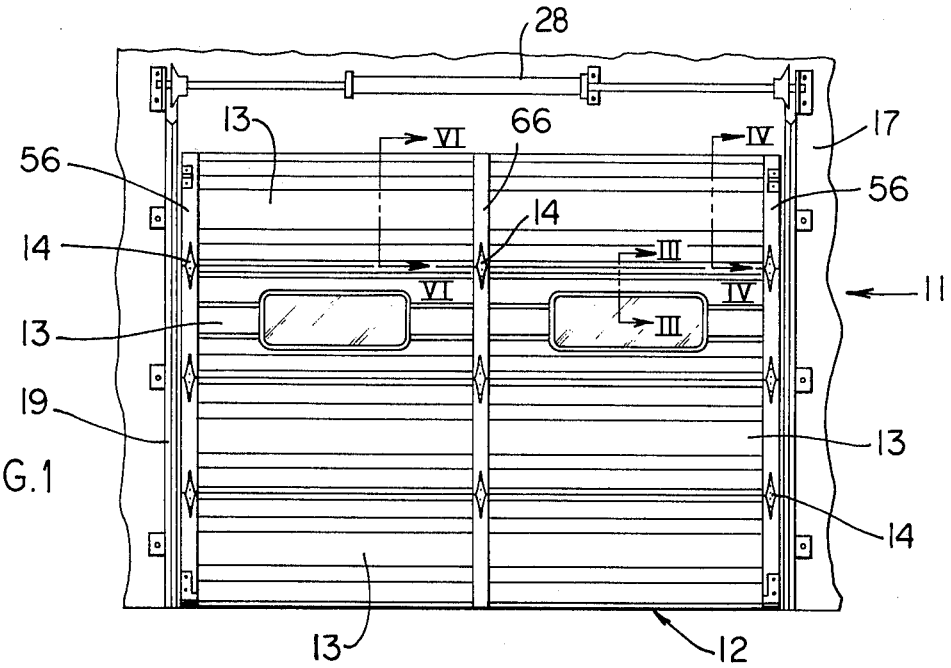
FIG. 1 is a fragmentary elevational view illustrating the rearward side of a typical sectional door installation.

Certain terminology will be used in the following description for convenience in reference only and will not be limiting. For example, the words "upwardly", "downwardly", "rightwardly" and "leftwardly" will refer to directions in the drawings to which reference is made. The word "front" or "forward" will refer to the side of the door which is normally positioned exteriorly of the building, namely the left side as appearing in FIGS. 2–8, whereas the word "rear" will refer to the interior side of the door as appearing on the right side in FIGS. 2–8. The word "upwardly" will also refer to the normal direction of movement of the door as it is moved from a closed vertical position into an open horizontal position. The words "inward" and "outward" will refer to directions toward and away from, respectively, the geometric center of the door installation and designated parts thereof. Said terminology will include the words above specifically mentioned, derivatives thereof and words of similar import.

SUMMARY OF THE INVENTION

The objects and purposes of the present invention, including those set forth above, have been met by providing a sectional or multipanel door wherein the individual panels are formed from a sheetlike material and have increased cross-sectional strength. Each panel has a substantially channel-shaped cross section defined by leg portions which determine the thickness of the door and interconnected by a web portion of substantial width. The web portion has a center strengthening portion formed therein, which strengthening portion is also of a channel-shaped configuration and opens in a direction opposite to the panel. The strengthening section has a depth which is at least approximately 75% of the overall thickness of the door so as to provide the individual panels with substantially increased sectional strength, particularly in the longitudinal direction thereof, whereby the resulting door can withstand substantially increased windloads. A light-weight channel-like end stile is secured to each end edge of the panel. A shallow channel-shaped center stile extends transversely across the inner side of the panel. The end and center stiles are each fixedly connected to the panel adjacent the opposite longitudinally extending edges thereof, and are also fixedly connected to the center strengthening portion. The individual panels are appropriately hingedly connected in a conventional manner to form a sectional door.

DETAILED DESCRIPTION

Figure 2:
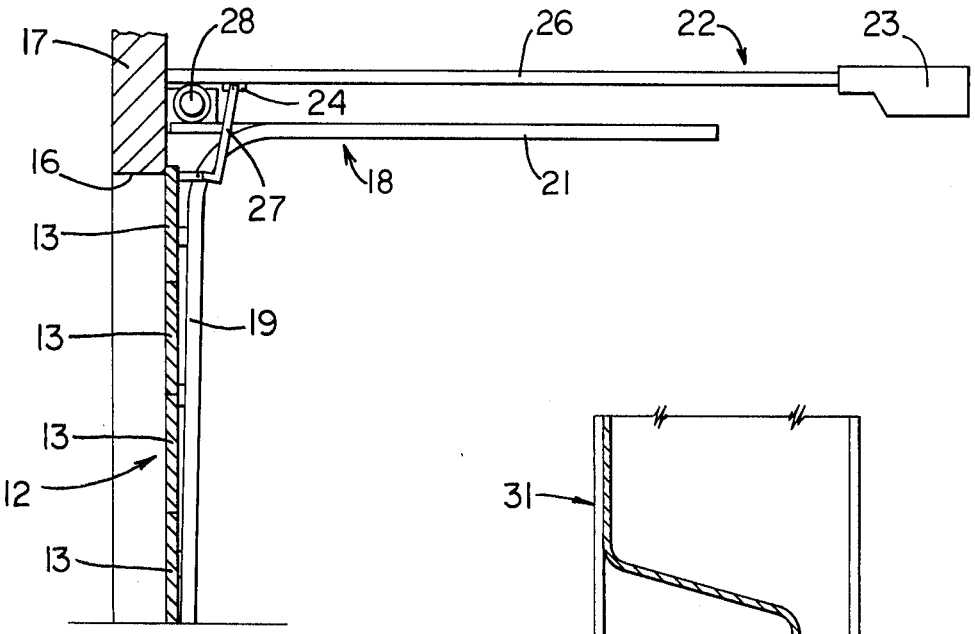
FIG. 2 is a fragmentary side elevational view, partially in cross section, of the door installation illustrated in FIG. 1.

FIGS. 1 and 2 illustrate a somewhat conventional door installation 11 which includes a sectional door 12 formed from a plurality of individual panels 13 which are interconnected by hinges 14. The door is adapted to close an opening 16 formed in a wall 17 when disposed in a substantially vertical position as illustrated in FIG. 2. However, the door is movable into an open position wherein it is disposed substantially horizontally, and for this purpose the door is supported on a pair of opposed guide tracks 18 which include substantially vertical track portions 19 disposed adjacent the edges of the door opening and which connect to overhead horizontal track portions 21 which support the door in its open position.

The door is movable between its open and closed positions by an operator 22 which includes a motor 23 drivingly interconnected to a carriage 24 by means of an intermediate driving member, such as a screw, chain or the like (not shown). The carriage 24 is slidably supported on a pair of opposed stationary guide rails 26, and the carriage in turn is connected by a link 27 to the door 13. A conventional spring counter-balance mechanism 28 is disposed adjacent the upper edge of the door opening and is interconnected to the lower edge of the door by means of cables (not shown) to assist the operator 22 during the opening movement of the door.

The door installation 11 as briefly described above is conventional, and thus further description of same is not believed necessary.

Figure 4:
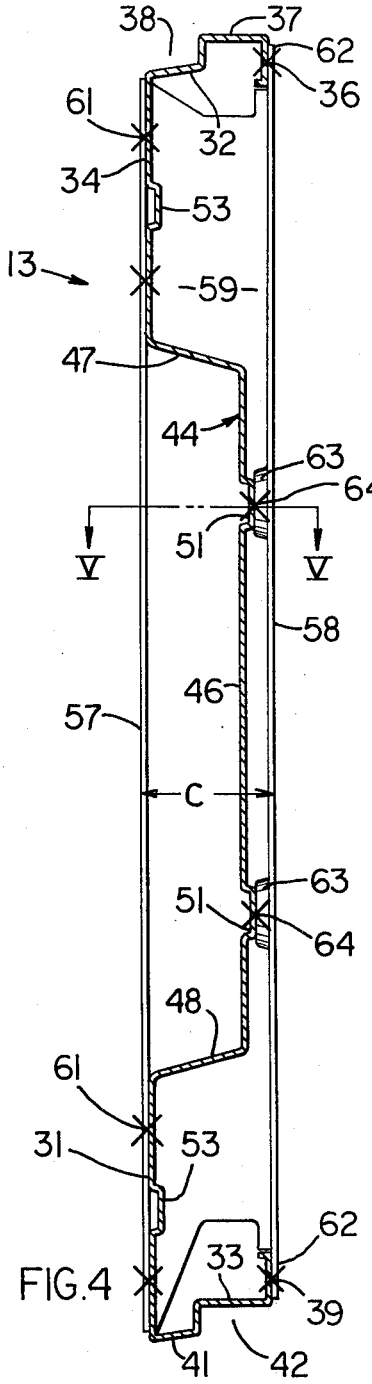
FIG. 4 is an enlarged cross-sectional view of an improved door panel as taken along line IV—IV in FIG. 1.
Figure 6:
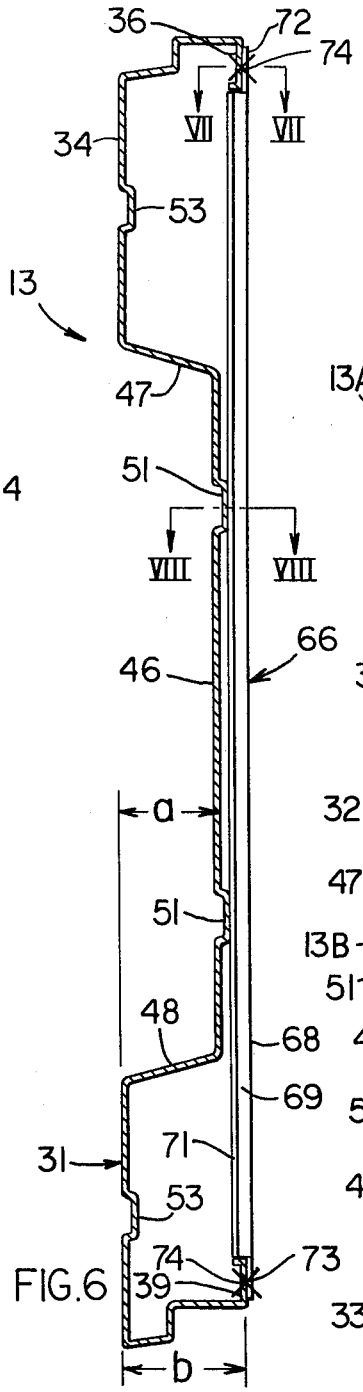
FIG. 6 is an enlarged sectional view of the door panel as taken along line VI—VI in FIG. 1.

According to the present invention, the door panels 13 are formed with an improved cross-sectional configuration. Specifically, each panel 13 is, as illustrated in FIGS. 4 and 6, of a generally channel-shaped section 31 defined by end walls 32 and 33 interconnected by a rather wide web 34. The upper end wall 32 includes an inwardly directed flange 36 which is substantially parallel to the wall 34 and extends inwardly from the longitudinally extending edge of the panel. The flange 36 is integral with an upwardly projecting channel-like part 37 which extends partway across the thickness of the panel. The end wall 32 in addition includes a shouldered recess 38 adjacent the front side thereof.

The lower end wall 33 is of a construction somewhat similar to the upper end wall 32 and includes an inwardly projecting flange 39 disposed on the rearward side thereof and positioned substantially parallel with the front wall or web 34. The flange 39 is integral with a shouldered recess 42, which recess is positioned adjacent to but rearwardly of the downwardly projecting channel-like part 41.

The section member 31 also includes a channel-shaped stiffening portion 44 formed substantially centrally thereof and extending throughout the longitudinal length of the section 31. The stiffening portion 44 is defined by an offset web or wall portion 46 which is substantially parallel to but transversely and laterally spaced from the front wall 34. The wall portion 46 is connected to the upper part of the wall 34 by means of a first shoulder 47, and is connected to the lower portion of the wall 34 by means of a further shoulder 48.

The wall 46 of the stiffening portion 44 is preferably provided with one or more rib or channel-like protrusions formed therein, such as the protrusions 51, which protrusions project rearwardly of the section 31 and extend longitudinally throughout the length thereof in substantially parallel relationship. Similiar protrusions 53 can also be formed in the upper and lower front wall portions 34. The protrusions 51 and 53 improve the strength and rigidity of the section 31, particularly in the longitudinal direction thereof, and in addition facilitate the overall assembly of the door panel 13, as explained hereinafter.

As illustrated in FIGS. 4 and 6, the channel-shaped stiffening portion 44 opens in a direction opposite to the channel-shaped section 31, inasmuch as stiffening portion 44 opens forwardly of the door whereas section 31 generally opens rearwardly of the door. The stiffening portion 44 has a depth which approaches, but is less than, the overall depth of the individual door panels. For example, as illustrated in FIG. 6, the individual channel-shaped section 31 has a thickness or depth which is measured by the dimension *b*, which depth is only slightly smaller than the depth *c* of the overall assembled panel 13. The stiffening portion 44, on the other hand, has a depth *a* which comprises at least approximately 70%, and preferably 75%, of the overall depth *c* of the panel 13. The depth *a* of the stiffening portion 44 is preferably at least approximately 80% of the overall section depth *b*.

Each panel 13 additionally includes an elongated end stile 56 fixedly connected to each of the end edges of the channel section 31. The end stile 56, which is normally extruded from aluminum or other light weight metal, is of a generally channel-shaped configuration (see FIGS. 4 and 5) and includes substantially parallel front and rear legs 57 and 58, respectively, interconnected by a web 59. The front leg 57 extends inwardly adjacent the front face of the panel and overlaps a portion of the wall 34. Front leg 57 is appropriately secured to the upper and lower portions of the wall 34, as by being spot welded at the areas noted 61.

Figure 5:
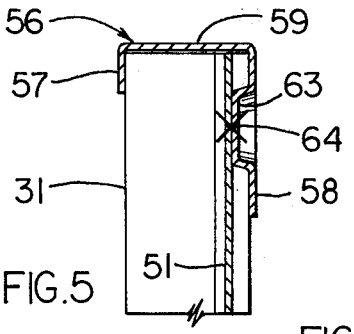
FIG. 5 is a fragmentary sectional view taken along line V—V in FIG. 4.

The rear leg 58 of end stile 56 is, as shown in FIG. 5, of a length substantially greater than the front leg 57. The rear leg 58 has the upper and lower ends thereof fixedly connected to the flanges 72 and 73, as by spot welding at 62. The leg 58 also has a pair of cuplike protrusions 63 formed therein and positioned so that they project inwardly so as to engage the riblike protrusions 51 formed in the stiffening portion 44. The protrusions 63 are fixedly secured to the stiffening protrusions 51 as by spot welding at 64.

The panel 13 is also provided with one or more center stiles 66 fixedly secured thereto and extending transversely across the section 13 in parallel relationship to the end stiles 56. The number of center stiles 66 utilized is dependent upon the overall width of the door, there being only one center stile per panel in the illustrated embodiment. The center stile 66 is, like the end stiles 56, preferably formed of metal, as by being extruded from aluminum.

Figure 7:
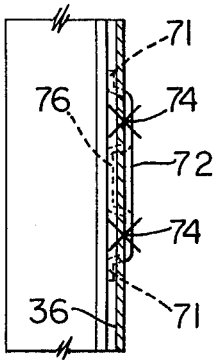
FIG. 7 is a fragmentary sectional view taken along line VII—VII in FIG. 6.
Figure 8:
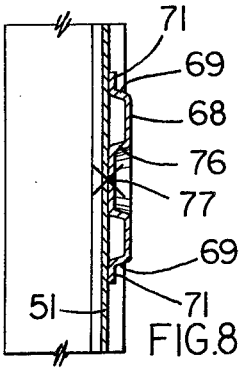
FIG. 8 is a fragmentary sectional view taken along line VIII—VIII in FIG. 6.

As illustrated in FIGS. 6–8, the center stile 66 is of a shallow channel-shaped cross section and includes a substantially planer web portion 68 disposed between a pair of inwardly extending leg portions 69, which leg portions 69 in turn terminate in outwardly projecting foot portions 71 which are positioned in engagement with the riblike protrustions 51. The center stile 66 extends transversely of the section 31 between the upper and lower flanges 36 and 39 as illustrated in FIG. 6. However, the web portion 68 is provided with planer extensions 72 and 73, fixedly, here integrally, connected thereto. These extensions 72 and 73 which overlap the flanges 36 and 39, respectively, and are appropriately fixedly connected thereto, as by spot welds 74. The web portion 68 also has an appropriate number of cuplike protrusions 76 formed therein, there being one such protrusion 76 positioned for engagement with each of the riblike protrusions 51 formed in the stiffening portion 44. These opposed protrusions 51 and 76 are fixedly connected, as by spot welds 77. As is apparent from inspection of FIGS. 6–8, the center stile 66 is extremely shallow or narrow relative to the overall depth of the panel 13, and in fact the stile 66 constitutes only a very small fraction of the overall depth of the panel 13, being less than 25% and preferably no more than about 15% of the overall panel depth.

Figure 3:
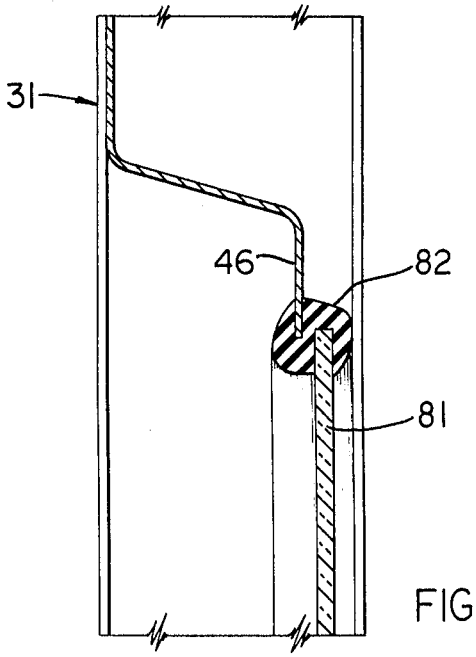
FIG. 3 is an enlarged fragmentary sectional view taken along line III—III in FIG. 1.

As illustrated in FIGS. 1 and 3, one of the panels 13 can be provided with windows therein if desired. For this purpose, suitable openings are cut in the wall 46 and an appropriate window 81 is disposed in the opening, being held therein by an appropriate glazing strip or molding 82.

Figure 9:
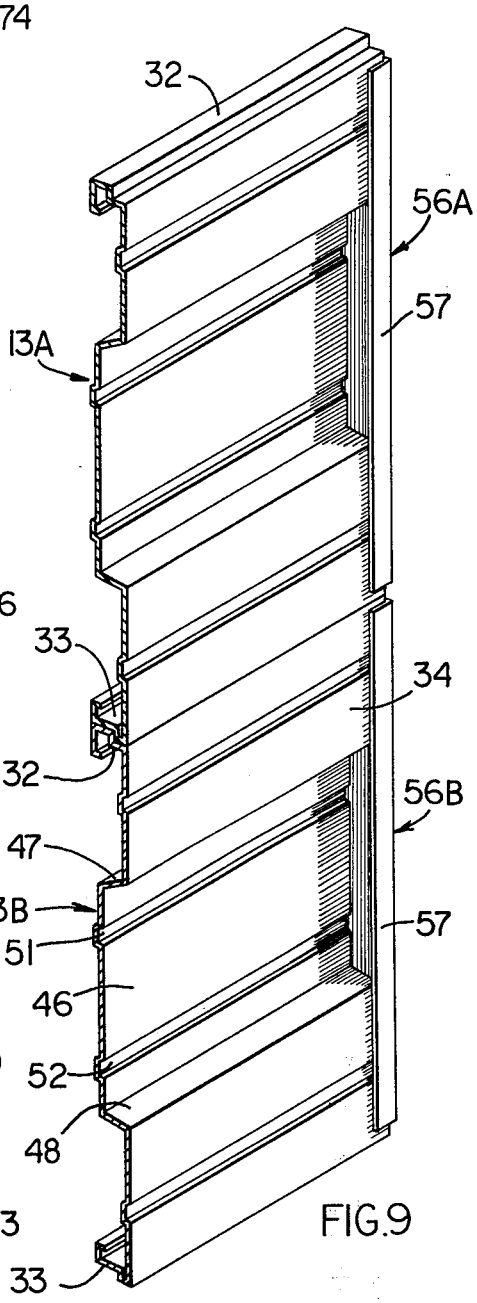
FIG. 9 is a fragmentary perspective view illustrating the manner in which two panels structurally coact.

FIG. 9 illustrates therein the manner in which a plurality of identical panels 13 are disposed in adjacent relationship to form a multipanel door 12. While FIG. 9 illustrates thereon only two such panels, which panels are identical but have been designated 13A and 13B for clarity of reference, nevertheless it will be appreciated that any desired number of panels can be connected to form the door. The adjacent panels, such as 13A and 13B in FIG. 9, are appropriately interconnected by hinges 14 as illustrated in FIG. 1, which hinges are mounted on the adjacent ends of the end and center stiles 56 and 66, respectively. As is conventional with sectional doors of this type, the hinges support thereon suitable guide rollers which are engaged within the guide tracks 18.

As an example as to the pertinent sizes of the panel 13, and specifically the section 31, the section member 31 in one desired form of the invention has a depth *b* of 1.625 inches, whereas the overall depth *c* of the panel 13 (which corresponds to the thickness of the door) is 1¾ inches. The stiffening portion 44 of the section 31, on the other hand, has a thickness *a* of approximately 1.30 inches. The section 31 is preferably rolled from sheet metal, such as 26 gauge (approximately 0.0217 inch thickness galvanized steel. The center and end stiles 56 and 66 are also preferably rolled from sheet material, such as 18 gauge (0.045 inch thickness) galvanized steel. The center stile 56 has an overall depth (that is, the dimension which appears horizontally in FIG. 8) of approximately ¼ inch.

Due to the substantially increased depth of the stiffening portion 44 relative to the overall thickness of the panel, the door thus has substantially increased strength in the horizontal direction when the door is closed, and is thus able to withstand substantially increased wind loads. At the same time, the increased depth of the strengthening portion 44 of the individual panels likewise results in increased transverse strength of the individual panels, that is increased strength in the vertical direction when the door is closed, so that the stiles and particularly the center stile can thus be of substantially smaller cross section. The resulting door is thus of increased strength and at the same time permits utilization of stiles which are smaller, of simpler configuration, and of lighter weight.

The operation of the overall door installation is conventional and thus description thereof is not believed necessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a multipanel door having a plurality of horizontally elongated and substantially rectangular panels having their adjacent horizontally extending edges hingedly connected to permit movement of said door between a closed substantially vertical position and an open substantially horizontal position, each panel including a horizontally elongated one-piece section member formed from a thin sheetlike material and having a generally channel-shaped cross section when viewed in a plane perpendicular to said horizontal direction, said section member having opposed leg portions of rather short length interconnected by a web portion which has a width several times greater than the length of said leg portions, said leg portions each having a shouldered recess formed therein so that the opposed leg portions of adjacent section members interfit one with the other, comprising the improvement wherein said web portions includes a stiffening portion formed centrally thereof and extending longitudinally throughout the length of said section member, said stiffening portion being of a generally channel-shaped cross section which opens outwardly in a direction opposite to said channel-shaped section member, said web portion also includes a pair of substantially planer portions which are spaced from one another and disposed adjacent the opposite longitudinally extending edges of said section member, said planar portions being spaced apart and interconnected by said channel-shaped stiffening portion, the channel-shaped stiffening portion including relatively short leg parts which are connected to the adjacent edges of the planer portions and project inwardly into said section member, said leg parts being interconnected by a substantially planar web part which has a width which is several times greater than the length of said leg parts, the width of said web parts also being greater than the width of said planer portions, said web part being disposed substantially parallel to said planer portions but spaced both transversely and laterally therefrom, said web part being disposed between but spaced from first and second parallel planes, said first plane being defined by said planer portions and said second plane being defined by the longitudinally extending free edges of said leg portions, said web part being positioned more closely adjacent said second plane so that said channel-shaped stiffening portion has a depth which is at least approximately 70% of the depth of the panel, each panel also including a pair of end stiles fixedly connected to the opposite end edges of the section member, said end stiles extending in a direction perpendicular to said horizontal direction, each said panel further including at least one intermediate stile which is disposed between and substantially parallel to said end stiles, said intermediate stile being disposed adjacent the open side of said section member and fixedly interconnected thereto, said planar portions and said planar web part each having a channel-like rib formed therein and extending longitudinally therealong, said ribs projecting rearwardly of said section member toward said second plane, and said stiles all having means thereon directly fixedly interconnected to the rib of said planar web part.

2. In a multipanel door having a plurality of horizontally elongated and substantially rectangular panels having their adjacent horizontally extending edges hingedly connected to permit movement of said door between a closed substantially vertical position and an open substantially horizontal position, each panel including an elongated section member formed from a thin sheetlike material and having a generally channel-shaped cross section when viewed in a plane perpendicular to said horizontal direction, said section member having opposed leg portions of rather short length interconnected by a web portion which has a width several times greater than the length of said leg portions, comprising the improvement wherein said web portion includes a stiffening portion formed centrally thereof and extending longitudinally throughout the length of said section member, said stiffening portion being of a generally channel-shaped cross section which opens outwardly in a direction opposite to said channel-shaped section member, said web portion also includes a pair of substantially planer portions which are spaced from one another and disposed adjacent the opposite longitudinally extending edges of said section member, said planer portions being spaced apart and interconnected by said channel-shaped stiffening portion, the channel-shaped stiffening portion including relatively short leg parts which are connected to the adjacent edges of the planer portions and project inwardly into said section member, said leg parts being interconnected by a substantially planer web part which has a width which is several times greater than the length of said leg parts, the width of said web part also being greater than the width of said planar portions, said web part being disposed substantially parallel to said planer portions but spaced both transversely and laterally therefrom, said web part being disposed between but spaced from first and second parallel planes, said first plane being defined by said planer portions and said second plane being defined by the longitudinally extending free edges of said leg portions, said web part being positioned more closely adjacent said second plane so that said channel-shaped stiffening portion has a depth which is at least approximately 70% of the depth of the panel, said web part having at least two longitudinally extending channel-like ribs formed therein and extending longitudinally therealong, said ribs projecting rearwardly of said web part in a direction toward said second plane, each panel also including a pair of substantially channel-shaped end stiles fixedly connected to and surrounding the opposite end edges of the section member, said end stiles extending in a direction perpendicular to said horizontal direction, each said panel further including at least one intermediate stile which is disposed between and substantially parallel to said end stiles, said intermediate stile being disposed adjacent the open side of said section member and fixedly interconnected thereto, said end stiles and said intermediate stile all having buttonlike protrusions formed thereon and projecting forwardly into engagement with said ribs, and means fixedly interconnecting said buttonlike protrusions to said ribs.

3. A door according to claim 2, wherein said stiffening portion has a depth which is approximately 75% of the depth of the panel and wherein said stiffening portion has a depth which is at least approximately 80% of the depth of the section member.

4. A door according to claim 2, wherein said intermediate stile is a straight channel-shaped rail and has a depth which is in the order of approximately 15% of the overall panel depth.

* * * * *